US009208935B2

(12) United States Patent
Yoon et al.

(10) Patent No.: US 9,208,935 B2
(45) Date of Patent: Dec. 8, 2015

(54) ELECTRONIC COMPONENT

(71) Applicant: Samsung Electro-Mechanics Co., Ltd., Suwon (KR)

(72) Inventors: Chan Yoon, Suwon (KR); Won Chul Sim, Sungnam (KR); Young Seuck Yoo, Seoul (KR); Sung Kwon Wi, Seoul (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 156 days.

(21) Appl. No.: 14/051,131

(22) Filed: Oct. 10, 2013

(65) Prior Publication Data

US 2014/0184376 A1 Jul. 3, 2014

(30) Foreign Application Priority Data

Dec. 28, 2012 (KR) ..... 10-2012-0156863

(51) Int. Cl.
*H01F 5/00* (2006.01)
*H01F 27/28* (2006.01)
*H01F 17/00* (2006.01)

(52) U.S. Cl.
CPC .... *H01F 17/0006* (2013.01); *H01F 2017/0073* (2013.01); *H01F 2017/0093* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

2008/0303621 A1* 12/2008 Ito et al. ..... 336/200
2010/0301966 A1* 12/2010 Yoshino et al. ..... 333/185

FOREIGN PATENT DOCUMENTS

JP 2002043129 A * 2/2002
JP 2003017327 A * 1/2003
JP 2010056177 A * 3/2010
KR 10-2007-0076722 7/2007

* cited by examiner

*Primary Examiner* — Tsz Chan
(74) *Attorney, Agent, or Firm* — McDermott Will & Emery LLP

(57) ABSTRACT

An electronic component including a substrate, an insulating unit provided on the substrate, and a conductor coil provided within the insulating unit, wherein a distance from the outermost portion of the conductor coil in one axial direction to the outermost portion of the substrate in one axial direction is greater than 0.0125 times a length of the substrate in one axial direction, thus having enhanced reliability.

9 Claims, 4 Drawing Sheets

ELECTRONIC COMPONENT

CROSS REFERENCE(S) TO RELATED APPLICATIONS

This application claims the benefit under 35 U.S.C. Section 119 of Korean Patent Application Serial No. 10-2012-0156863, entitled "Electronic Component" filed on Dec. 28, 2012, which is hereby incorporated by reference in its entirety into this application.

BACKGROUND OF THE INVENTION

1. Technical Field

The present invention relates to an electronic component and, more particularly, to a small electronic component such as an inductor or a common mode filter.

2. Description of the Related Art

Recently, electronic devices such as cellular phones, home appliances, personal computers (PCs), personal digital assistants (PDA), liquid crystal displays (LCDs), and the like, have been digitalized and implemented to have a high speed. Electronic devices are sensitive to external stimulation, so an introduction of a small abnormal voltage and high frequency noise into an internal circuit of an electronic device from the outside may damage the circuit or distort signals.

Causes of abnormal voltages or noise may include a lightning strike, electrostatic discharge from a human body, a switching voltage generated in a circuit, power noise included in a power source voltage, an unnecessary electromagnetic signal or electromagnetic noise, and the like, and in order to prevent an introduction of an abnormal voltage and high frequency noise into a circuit, a common mode filter is used.

A general structure of a related art common mode filter will be described with reference to Patent Document 1. A pair of conductor coils, which are magnetically coupled to one another, are formed on a substrate and surrounded by an insulating resin. Namely, when viewed from the outside, the common mode filter may have a structure in which the substrate and an insulating layer are laminated.

Meanwhile, in order to meet the demand for smaller and thinner electronic components, recently, products having a size equal to or smaller than 0.1 mm in width and length have been launched into markets, and in addition, efforts for reducing a thickness thereof are continued.

Here, there has been an attempt to minimize a thickness of an insulating material provided in a space between the substrate and the conductor coil to reduce the thickness of electronic components, but the reduction even with the shortest distance between the substrate and the conductor coil causes a generation of cracks between an insulating unit and the substrate.

RELATED ART DOCUMENT (Patent document 1) Korean Patent Laid Open Publication No. 2007-0076722

SUMMARY OF THE INVENTION

An object of the present invention is to provide an electronic component having a reduced thickness while having enhanced reliability and maintaining performance.

According to an embodiment of the present invention, there is provided an electronic component including a substrate, an insulating unit provided on the substrate, and a conductor coil provided within the insulating unit, wherein a distance from the outermost portion of the conductor coil in one axial direction to the outermost portion of the substrate in one axial direction is greater than 0.0125 times a length of the substrate in one axial direction.

The one axial direction may be any one of a longer axis direction and a shorter axis direction of the electronic component.

A distance from the outermost portion of the conductor coil in one axial direction to the outermost portion of the substrate in one axial direction may be smaller than 0.0625 times a length of the substrate in one axial direction.

The electronic component may be an inductor or a common mode filter.

The shortest distance between the substrate and the conductor coil may be greater than 1 um.

The shortest distance between the substrate and the conductor coil may be smaller than 20 um.

According to another embodiment of the present invention, there is provided an electronic component including a substrate, an insulating unit provided on the substrate, and a conductor coil provided within the insulating unit, wherein the conductor coil includes: a primary coil formed by winding a conductive material at least one turn; and a secondary coil formed by winding a conductive material at least one turn and spaced apart from the primary coil, wherein a distance from the outermost portion of the conductor coil in a shorter axis direction to the outermost portion of the substrate in the shorter axis direction is more than 0.0125 times and less than 0.0625 times a length of the substrate in the shorter axis direction, and a distance from the outermost portion of the conductor coil in a longer axis direction to the outermost portion of the substrate in the longer axis direction is more than 0.0125 times and less than 0.0625 times a length of the substrate in the longer axis direction.

The shortest distance between the substrate and the conductor coil may be more than 1 um and less than 20 um.

The substrate may include a magnetic substance.

A magnetic unit including a magnetic substance may be further formed on an upper portion of the insulating unit.

DESCRIPTION OF THE PREFERRED EMBODIMENTS

Figure 1:
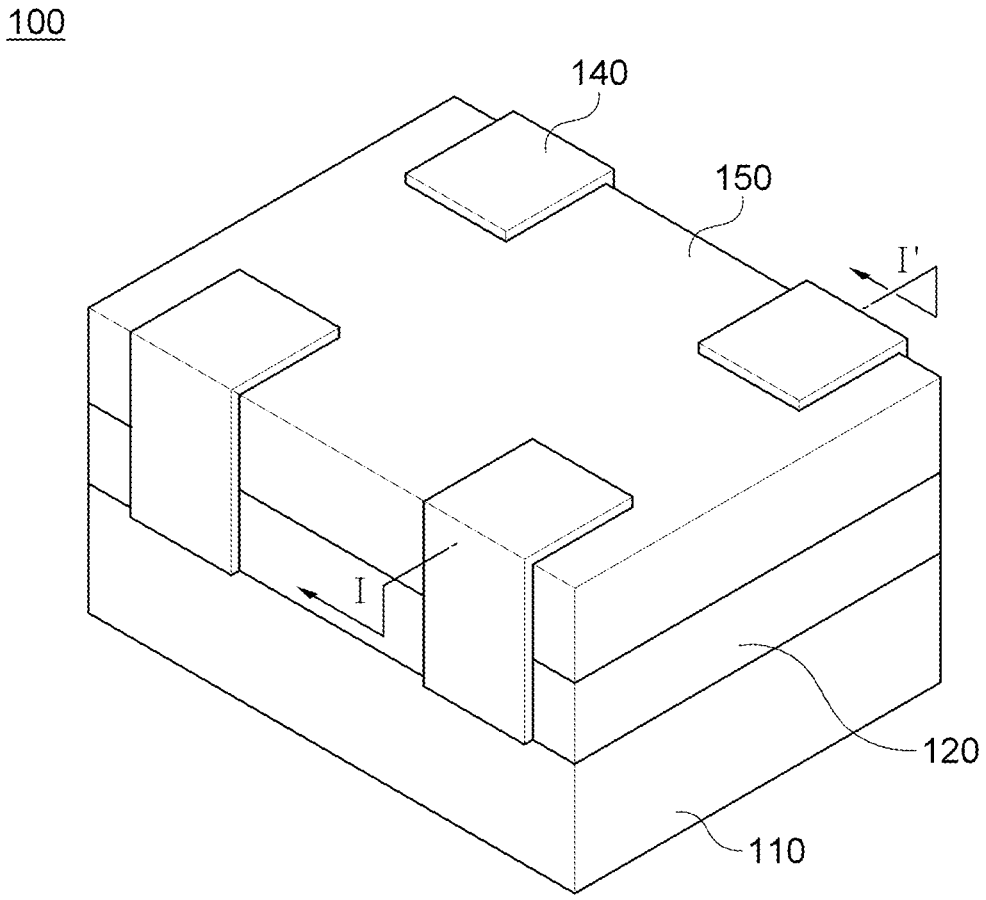
FIG. 1 is a perspective view illustrating an electronic component according to an embodiment of the present invention.

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art. Like reference numerals throughout the description denote like elements.

Terms used in the present specification are for explaining exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

For simplification and clearness of illustration, a general configuration scheme will be shown in the accompanying drawings, and a detailed description of the feature and the technology well known in the art will be omitted in order to prevent a discussion of exemplary embodiments of the present invention from being unnecessarily obscure. Additionally, components shown in the accompanying drawings are not necessarily shown to scale. For example, sizes of some components shown in the accompanying drawings may be exaggerated as compared with other components in order to assist in understanding of exemplary embodiments of the present invention. Like reference numerals on different drawings will denote like components, and similar reference numerals on different drawings will denote similar components, but are not necessarily limited thereto.

In the specification and the claims, terms such as "first", "second", "third", "fourth" and the like, if any, will be used to distinguish similar components from each other and be used to describe a specific sequence or a generation sequence, but is not necessarily limited thereto. It may be understood that these terms are compatible with each other under an appropriate environment so that exemplary embodiments of the present invention to be described below may be operated in a sequence different from a sequence shown or described herein. Likewise, in the present specification, in the case in which it is described that a method includes a series of steps, a sequence of these steps suggested herein is not necessarily a sequence in which these steps may be executed. That is, any described step may be omitted and/or any other step that is not described herein may be added to the method.

In the specification and the claims, terms such as "left", "right", "front", "rear", "top, "bottom", "over", "under", and the like, if any, are not necessarily to indicate relative positions that are not changed, but are used for description. It may be understood that these terms are compatible with each other under an appropriate environment so that exemplary embodiments of the present invention to be described below may be operated in a direction different from a direction shown or described herein. A term "connected" used herein is defined as being directly or indirectly connected in an electrical or non-electrical scheme. Targets described as being "adjacent to" each other may physically contact each other, be close to each other, or be in the same general range or region, in the context in which the above phrase is used. Here, a phrase "in an exemplary embodiment" means the same exemplary embodiment, but is not necessarily limited thereto.

Hereinafter, a configuration and an acting effect of exemplary embodiments of the present invention will be described in more detail with reference to the accompanying drawings.

Figure 2:
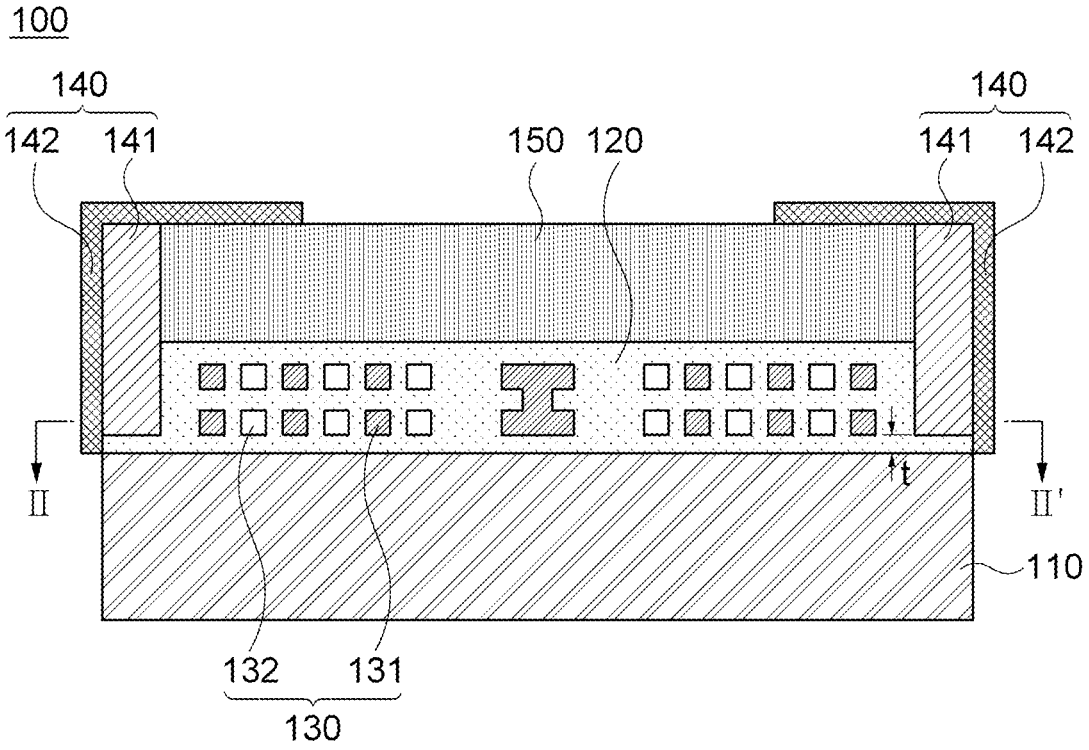
FIG. 2 is a cross-sectional view schematically illustrating a cutting plane taken along the line I-I' in FIG. 1.
Figure 3:
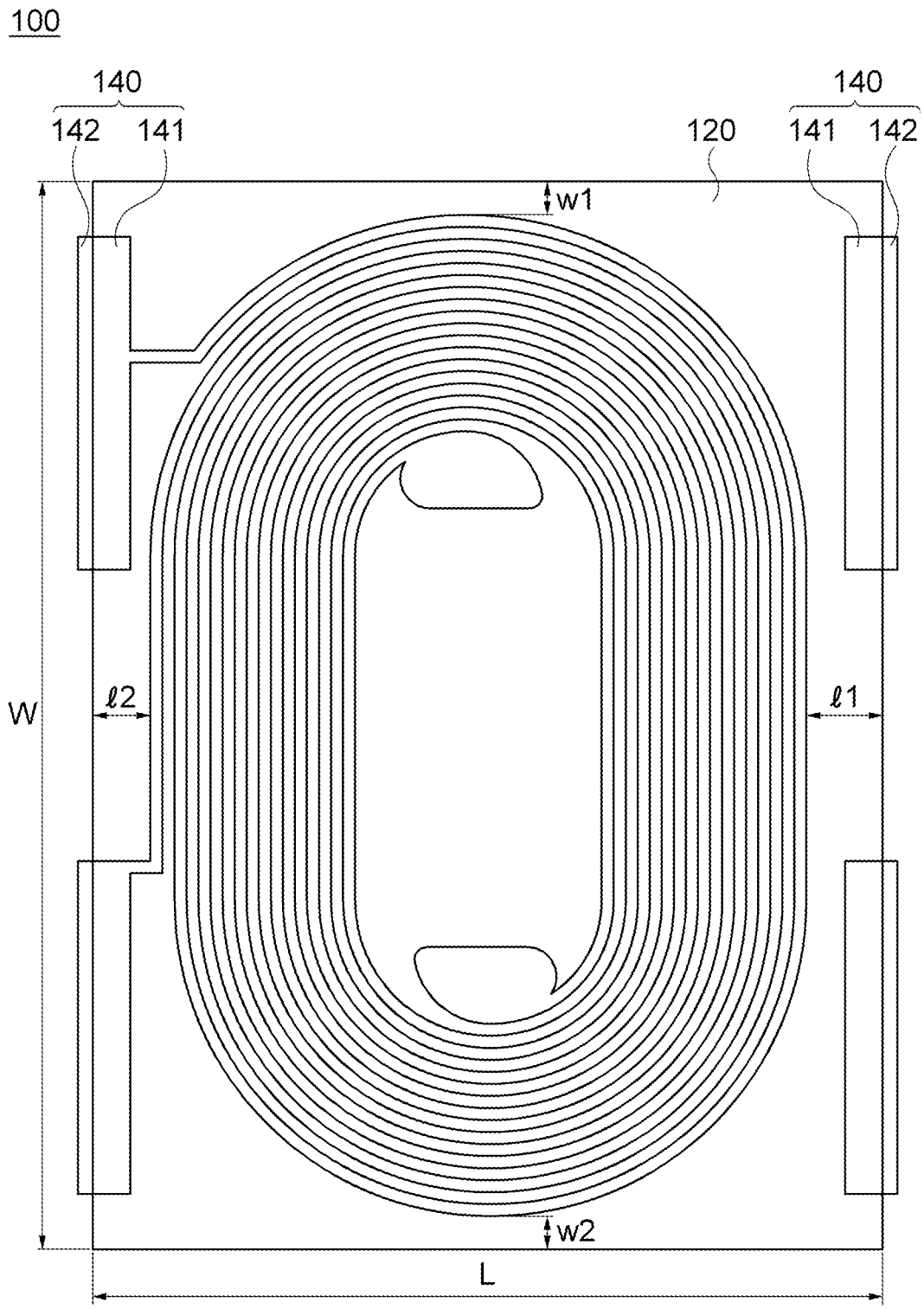
FIG. 3 is a cross-sectional view schematically illustrating a cutting plane of FIG. 1 taken along the line II-II' in FIG. 2.

FIG. 1 is a perspective view illustrating an electronic component according to an embodiment of the present invention. FIG. 2 is a cross-sectional view schematically illustrating a cutting plane taken along the line I-I' in FIG. 1. FIG. 3 is a cross-sectional view schematically illustrating a cutting plane of FIG. 1 taken along the line II-II' in FIG. 2.

Referring to FIGS. 1 through 3, an electronic component 100 may include a substrate 110, an insulating unit 120, and a conductor coil 130.

Here, the insulating unit 120 may be formed on the substrate 110, and the conductor coil 130 may be provided in the insulating unit 120.

The electronic component 100 may be, for example, an inductor, a common mode filter, or the like.

An inductor has a structure in which one conductor coil 130 is wound and one coil is wound between two terminals at both ends of the conductor coil 130. A common mode filter may have a structure in which two conductor coils 130 are wound and two terminals are connected to both ends of the respective conductor coils 130, respectively, i.e., totaling four terminals.

In particular, in the case of the common mode filter, the two conductor coils 130 may be called a primary coil 131 and a secondary coil 132, respectively. A magnetic substance may be included in the substrate 110, and a magnetic unit 150 may be further provided on an upper portion of the insulating unit 120.

An internal terminal 141 is provided to be electrically connected to the conductor coil 130 and formed in the interior and exterior of the insulating unit 120, and an external terminal 142 is electrically connected to the internal terminal 141 and provided at an outer side of the insulating unit 120 and the magnetic unit 150 to form an external electrode 140.

Meanwhile, in order to reduce a thickness of the electronic component 100, if a thickness of an insulating material provided in a space between the substrate 110 and the conductor coil 130 is reduced, cracks may be generated between the insulating unit 120 and the substrate 110.

Besides, in case in which a magnetic substrate is provided in the substrate 110, sufficient insulating properties cannot be secured between the substrate 110 and the conductor coil 130, causing leakage of a current.

The inventor of the present application repeatedly conducted research to solve such problems, and reached a conclusion that a crack phenomenon generated between the substrate 110 and the insulating unit 120 is reduced when the outermost portion of the conductor coil 130 is spaced apart from the outermost portion of the substrate 110 by more than a predetermined distance.

In this respect, however, as the outermost portion of the conductor coil 130 becomes distant from the outermost portion of the substrate 110, a crack phenomenon is further reduced, but an area in which the conductor coil 130 is provided may also be reduced, resulting in a degradation of the main properties, such as common mode impedance, and the like, of the electronic component 100.

Thus, the inventor of the present application developed the electronic component 100 capable of achieving the foregoing objects within a limitation in which a crack generation rate is reduced, insulating characteristics are enhanced, and in particular, in the case of a common mode filter, a reduction in common mode impedance characteristics is prevented.

Hereinafter, the characteristics of an embodiment of the present invention will be described in detail with reference to FIGS. 1 through 5 and [Table 1] to [Table 4].

Experimental Example 1

[Table 1] below shows results obtained by measuring crack generation, insulation resistance, and a common mode impedance of common mode filter in which the primary coil 131 and the secondary coil 132 each having a line width of 12 um and a thickness of 10 um were wound ten turns (i.e., 10 times of winding number or turn number) at pitch of 8 um, respectively, and a longer axis length and a shorter axis length were 0.8 mm and 0.6 mm, respectively, by changing l1, l2, w1 and w2, while 't' was fixed to 10 um.

Here, 't' indicates the shortest distance between the substrate 110 and the conductor coil 130, l1 and l2 indicate distances between the outermost portions of the conductor coil 130 and the outermost portions of the substrate 110 based on a shorter axis direction of the substrate 110, and w1 and w2 indicate distance between the outermost portions of the conductor coil 130 and the outermost portions of the substrate 110 based on a longer axis direction of the substrate 110.

Also, as for a crack generation, moisture load resistance test was performed under conditions of 60±3, 90-95% RH, DC10V, DC 100 mA, 500±12 h, and an example in which cracks having a length of Sum or greater was determined to have cracks.

These definition and testing methods were also applied in the same manner for Experimental Examples 2 to 4.

TABLE 1

| Classification | Min{l1, l2} (um) | Min{w1, w2} (um) | Crack | IR ($10^9$ Ω) | Common mode impedance (Ω) |
|---|---|---|---|---|---|
| #1 | 7.5 | 10 | ○ | 0.0114 | — |
| #2 | 7.5 | 15 | ○ | 0.0234 | — |
| #3 | 7.6 | 10 | ○ | 0.0118 | — |
| #4 | 7.6 | 11 | x | 9.80 | 90.51 |
| #5 | 10 | 10 | ○ | 0.0218 | — |
| #6 | 10 | 15 | x | 9.20 | 89.62 |
| #7 | 10 | 20 | x | 23.0 | 91.05 |
| #8 | 20 | 40 | x | 8.90 | 85.03 |
| #9 | 30 | 30 | x | 9.34 | 81.33 |
| #10 | 35 | 45 | x | 9.52 | 78.21 |

Referring to [Table 1], it can be seen that when a smaller value among l1 and l2 is greater than 7.5 um and a smaller value among w1 and w2 is greater than 10 um, no crack was generated.

Meanwhile, it can be seen that common mode impedance was gradually reduced as 't' was increased.

Figure 4:
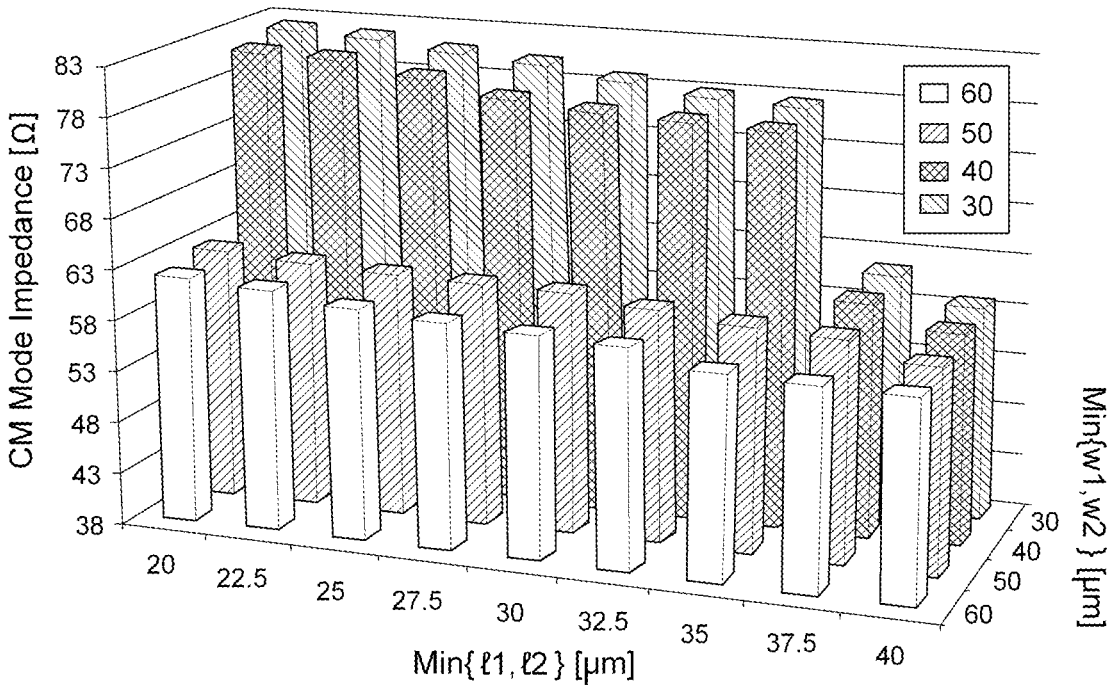
FIG. 4 is a graph schematically showing relationships between distances from the outermost portions of a conductor coil to the outermost portions of a substrate and common mode impedance in an electronic component according to an embodiment of the present invention.

FIG. 4 is a graph schematically showing relationships between distances from the outermost portions of the conductor coil 130 to the outermost portions of the substrate 110 and common mode impedance in the electronic component 100 according to an embodiment of the present invention.

Here, in FIG. 4, it is illustrated how the common mode impedance values were changed as the smaller value among l1 and l2 is increased by the unit of 2.25 um and the smaller value among w1 and w2 is increased by the unit of 10 um, under the same conditions as those from which the results of [Table 1] were derived.

As illustrated in FIG. 4, in case that the smaller value among l1 and l2 is increased to be 37.5 um or greater and the smaller value among w1 and w2 is 50 um or greater, common mode impedance values are sharply reduced.

When the above matters are put together, it can be understood that when the common mode filter having the longer axis length of 0.8 mm and the shorter axis length of 0.6 mm satisfies the conditions of 7.5 um<Min{l1, l2}<37.5 um and 10 um<Min{w1, w2}<50 um, desirable outcomes are obtained.

Experimental Example 2

[Table 2] below results obtained by measuring crack generation, insulation resistance, and a common mode impedance of common mode filter in which the primary coil 131 and the secondary coil 132 each having a line width of 9 um and a thickness of 10 um were wound ten turns at pitch of 6 um, respectively, and a longer axis length and a shorter axis length were 0.6 mm and 0.5 mm, respectively, by changing l1, l2, w1 and w2, while 't' was fixed to 10 um.

TABLE 2

| Classification | Min{l1, l2} (um) | Min{w1, w2} (um) | Crack | IR ($10^9$ Ω) | Common mode impedance (Ω) |
|---|---|---|---|---|---|
| #11 | 5 | 5 | ○ | 0.0135 | — |
| #12 | 6.25 | 10 | ○ | 0.0185 | — |
| #13 | 6.25 | 7.5 | ○ | 0.0094 | — |
| #14 | 6.3 | 7.5 | ○ | 0.0201 | — |
| #15 | 6.3 | 8 | x | 9.98 | 90.33 |
| #16 | 10 | 7.5 | ○ | 0.0234 | — |
| #17 | 10 | 15 | x | 10.15 | 90.12 |
| #18 | 10 | 20 | x | 9.54 | 88.05 |
| #19 | 20 | 30 | x | 21.0 | 82.02 |
| #20 | 25 | 30 | x | 9.87 | 80.95 |

Referring to [Table 2], it can be seen that when a smaller value among l1 and l2 is greater than 6.25 um and a smaller value among w1 and w2 is greater than 7.5 um, no crack was generated.

Meanwhile, it can be seen that common mode impedance was gradually reduced as 't' was increased.

Figure 5:
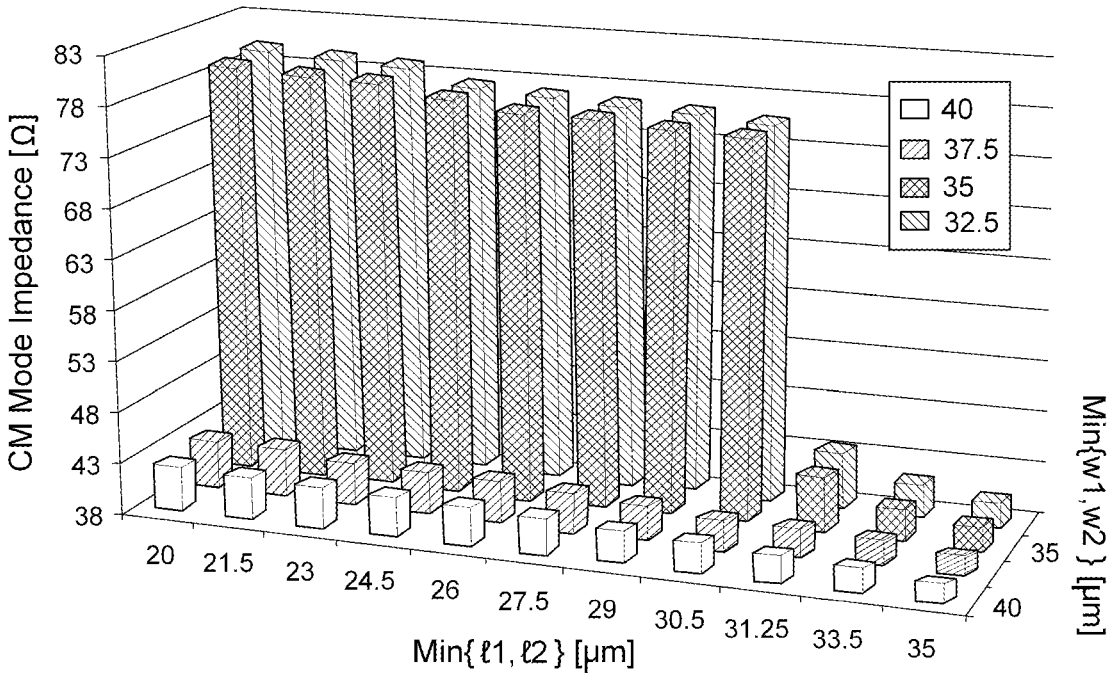
FIG. 5 is a graph schematically showing relationships between distances from the outermost portion of a conductor coil to the outermost portion of a substrate and common mode impedance in an electronic component according to another embodiment of the present invention.

FIG. 5 is a graph schematically showing relationships between distances from the outermost portions of the conductor coil 130 to the outermost portions of the substrate 110 and common mode impedance in the electronic component 100 according to an embodiment of the present invention.

Here, in FIG. 5, it is illustrated how the common mode impedance values changed as the smaller value among l1 and l2 is increased by the unit of 1.5 um and the smaller value among w1 and w2 is increased by the unit of 2.5 um, under the same conditions as those from which the results of [Table 2] were derived.

As illustrated in FIG. 5, in case that the smaller value among l1 and l2 is increased to be 31.25 um or greater and the smaller value among w1 and w2 is 37.5 um or greater, common mode impedance values are sharply reduced.

When the above matters are put together, it can be understood that when the common mode filter having the longer axis length of 0.6 mm and the shorter axis length of 0.5 mm satisfies the conditions of 7.5 um<Min{l1, l2}<37.5 um and 10 um<Min{w1, w2}<50 um, desirable outcomes are obtained.

Meanwhile, when an optimal range of the distance l1 or l2 from the outermost portions of the conductor coil 130 in the shorter axis direction to the outermost portions of the substrate 110 in the shorter axis direction is divided by the length L of the substrate 110 in the shorter axis direction, the following results may be obtained.

First, according to the results of Experimental Example 1, 0.0125<(Min{l1, l2})/L<0.0625 is satisfied in the case of the shorter axis direction, and 0.0125<(Min{w1, w2})/L<0.0625 is also satisfied in the case of the longer axis direction.

Also, in the results of Experimental Example 2, similarly, 0.0125<(Min{l1, l2})/L<0.0625 is satisfied in the case of the shorter axis direction, and 0.0125<(Min{w1, w2})/L<0.0625 is also satisfied in the longer axis direction.

Thus, when the above results of Experimental Example 1 and Experimental Example 2 are put together, it can be understood that a similar ratio of the distance from the outermost portions of the conductor coil 130 to the outermost portions of the substrate 110 by which a maximum common mode impedance value is obtained while reducing a possibility of crack generation may be applied in the case of the longer axis or in the case of the shorter axis, and in addition, the similar ratio may be applied even though the size of the common mode filter is changed.

Experimental Example 3

[Table 3] below shows results obtained by measuring crack generation, insulation resistance, and a common mode impedance of common mode filter in which the primary coil 131 and the secondary coil 132 each having a line width of 12 um and a thickness of 10 um were wound ten turns at pitch of 8 um, respectively, and a longer axis length and a shorter axis length were 0.8 mm and 0.6 mm, respectively, by changing 't'. Namely, [Table 3] shows results obtained by conducting a test under the conditions similar to those of <Experimental Example 1> by using t as a variable.

TABLE 3

| Classification | t (um) | Crack | IR ($10^9$ Ω) | Common mode impedance (Ω) |
|---|---|---|---|---|
| #21 | 0.5 | ○ | 0.0198 | — |
| #22 | 1.0 | ○ | 0.0211 | — |
| #23 | 1.5 | x | 8.90 | 92.01 |
| #24 | 2.0 | x | 9.30 | 91.54 |
| #25 | 2.5 | x | 9.15 | 90.81 |
| #26 | 3.0 | x | 9.20 | 89.55 |
| #27 | 3.5 | x | 9.08 | 89.12 |
| #28 | 4.0 | x | 9.12 | 89.02 |
| #29 | 4.5 | x | 8.98 | 89.29 |
| #30 | 5.0 | x | 9.21 | 87.00 |
| #31 | 10.0 | x | 9.01 | 85.23 |
| #32 | 15.0 | x | 9.15 | 81.40 |
| #33 | 20.0 | x | 8.90 | 55.08 |
| #34 | 25.0 | x | 9.20 | 47.07 |

Referring to [Table 3], in case of sample #21 and sample #22 in which t was equal to or less than 1 um, external cracks were checked, but in case of sample #23 to sample #34 in which t was equal to or more than 1.5, external cracks were not checked.

Also, measurement results of insulation resistance (IR) show that an insulation resistance value equal to or more than $8.90\times10^9\Omega$ was maintained in a section in which t was equal or more than 1.5 um, but the insulation resistance value was equal to or less than $2.11\times10^7\Omega$ in a section in which t was equal to or less than 1 um.

Also, it can be seen that the common mode impedance was gradually reduced as 't' was increased. In particular, it can be seen that common mode impedance was rapidly reduced in sample #33 in which t was 20 um, in comparison to sample #32 in which t was 15 um.

Experimental Example 4

[Table 4] below shows results obtained by measuring crack generation, insulation resistance, and a common mode impedance of common mode filter in which the primary coil 131 and the secondary coil 132 each having a line width of 9 um and a thickness of 10 um were wound ten turns at pitch of 6 um, respectively, and a longer axis length and a shorter axis length were 0.6 mm and 0.5 mm, respectively, by changing 't'. Namely, [Table 4] shows results obtained by conducting test under the conditions similar to those of <Experimental Example 2> by using t as a variable.

TABLE 4

| Classification | t (um) | Crack | IR ($10^9$ Ω) | Common mode impedance (Ω) |
|---|---|---|---|---|
| #35 | 0.5 | ○ | 0.0198 | — |
| #36 | 1.0 | ○ | 0.0211 | — |
| #37 | 1.5 | x | 8.80 | 93.50 |
| #38 | 2.0 | x | 9.20 | 93.10 |
| #39 | 2.5 | x | 9.50 | 92.42 |
| #40 | 3.0 | x | 9.01 | 92.55 |
| #41 | 3.5 | x | 9.15 | 92.00 |
| #42 | 4.0 | x | 9.31 | 90.07 |
| #43 | 4.5 | x | 9.25 | 89.33 |
| #44 | 5.0 | x | 9.21 | 89.04 |
| #45 | 10.0 | x | 9.01 | 83.11 |
| #46 | 15.0 | x | 9.15 | 80.56 |
| #47 | 20.0 | x | 8.90 | 56.42 |
| #48 | 25.0 | x | 9.20 | 41.21 |

Referring to [Table 4], in case of sample #35 and sample #36 in which t was equal to or less than 1 um, external cracks were checked, but in case of sample #37 to sample #48 in which t was equal to or more than 1.5, external cracks were not checked.

Also, measurement results of insulation resistance (IR) show that an insulation resistance value equal to or more than $8.80\times10^9\Omega$ was maintained in a section in which t was equal or more than 1.5 um, but the insulation resistance value was equal to or less than $2.11\times10^7\Omega$ in a section in which t was equal to or less than 1 um.

Also, it can be seen that the common mode impedance was gradually reduced as 't' was increased. In particular, it can be seen that common mode impedance was rapidly reduced in sample #47 in which t was 20 um, in comparison to sample #46 in which t was 15 um.

Based on the results of Experimental Example 3 and Experimental Example 4, it is preferable that t satisfies a range of 1.0 um<t<20 um in the electronic component 100 according to an embodiment of the present invention.

The present invention configured as described above provides an advantageous effect of providing a thinner electronic component while enhancing reliability and maintaining performance.

In particular, the electronic component according to an embodiment of the present invention is formed to be thinner while reducing a crack generation rate, and in addition, it can be formed to be thinner and have a reduced crack generation rate while maintaining performance such as common mode impedance, or the like.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions, and substitutions should also be understood to fall within the scope of the present invention.

What is claimed is:

1. An electronic component including a substrate, an insulating unit provided on the substrate, and a conductor coil provided within the insulating unit, wherein a distance from the outermost portion of the conductor coil in one axial direction to the outermost portion of the substrate in one axial direction is greater than 0.0125 times a length of the substrate in one axial direction and is smaller than 0.0625 times a length of the substrate in one axial direction.

2. The electronic component according to claim 1, wherein the one axial direction is any one of a longer axis direction and a shorter axis direction of the electronic component.

3. The electronic component according to claim 2, wherein the electronic component is an inductor or a common mode filter.

4. The electronic component according to claim 2, wherein the shortest distance between the substrate and the conductor coil is greater than 1 μm.

5. The electronic component according to claim 4, wherein the shortest distance between the substrate and the conductor coil is smaller than 20 μm.

6. An electronic component including a substrate, an insulating unit provided on the substrate, and a conductor coil provided within the insulating unit, wherein the conductor coil includes:

a primary coil formed by winding a conductive material at least one turn; and a secondary coil formed by winding a conductive material at least one turn and spaced apart from the primary coil, wherein a distance from the outermost portion of the conductor coil in a shorter axis direction to the outermost portion of the substrate in the shorter axis direction is more than 0.0125 times and less than 0.0625 times a length of the substrate in the shorter axis direction, and a distance from the outermost portion of the conductor coil in a longer axis direction to the outermost portion of the substrate in the longer axis direction is more than 0.0125 times and less than 0.0625 times a length of the substrate in the longer axis direction.

7. The electronic component according to claim 6, wherein the shortest distance between the substrate and the conductor coil is more than 1 μm and less than 20 μm.

8. The electronic component according to claim 7, wherein the substrate includes a magnetic substance.

9. The electronic component according to claim 7, wherein a magnetic unit including a magnetic substance is further formed on an upper portion of the insulating unit.

* * * * *